US006962516B2

(12) United States Patent
Ohki et al.

(10) Patent No.: US 6,962,516 B2
(45) Date of Patent: Nov. 8, 2005

(54) VOLTAGE APPLYING APPARATUS, AND APPARATUS AND METHOD FOR MANUFACTURING ELECTRON SOURCE

(75) Inventors: Kazuhiro Ohki, Chiba (JP); Shigeto Kamata, Kanagawa (JP); Akihiro Kimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/236,983

(22) Filed: Sep. 9, 2002

(65) Prior Publication Data

US 2003/0052617 A1 Mar. 20, 2003

(30) Foreign Application Priority Data

Sep. 17, 2001 (JP) ..... 2001-281636

(51) Int. Cl.[7] ..... H01J 9/00; H01J 9/42

(52) U.S. Cl. ..... 445/63; 445/3; 324/756; 324/758; 324/760

(58) Field of Search ..... 445/3, 63; 324/756, 324/758, 760

(56) References Cited

U.S. PATENT DOCUMENTS

| | | | | | |
|---|---|---|---|---|---|
| 4,987,303 | A | * | 1/1991 | Takase et al. | 324/662 |
| 5,559,446 | A | * | 9/1996 | Sano | 324/760 |
| 5,593,335 | A | * | 1/1997 | Suzuki et al. | 445/50 |
| 5,622,634 | A | | 4/1997 | Noma et al. | 216/40 |
| 5,677,635 | A | * | 10/1997 | Fujii et al. | 324/758 |
| 6,137,300 | A | * | 10/2000 | Hayashida | 324/758 |
| 6,169,356 | B1 | | 1/2001 | Ohnishi et al. | 313/495 |
| 6,552,559 | B2 | * | 4/2003 | Hiromatsu | 324/758 |
| 2001/0036682 | A1 | | 11/2001 | Takeda et al. | 438/34 |

FOREIGN PATENT DOCUMENTS

| | | | | |
|---|---|---|---|---|
| EP | 0 658 924 B1 | | 6/1995 | |
| EP | 0 660 537 A1 | | 6/1995 | |
| EP | 1032013 A2 | * | 8/2000 | |
| JP | 7-235255 | | 9/1995 | |
| JP | 07-235255 | | 9/1995 | H01J/1/30 |
| JP | 08-171849 | | 7/1996 | H01J/9/02 |
| JP | 2000-243282 | | 9/2000 | H01J/9/39 |
| JP | 2000-251664 | | 9/2000 | H01J/9/02 |
| JP | 2000-251685 | | 9/2000 | H01J/9/02 |
| WO | WO00/14761 | | 3/2000 | H01J/9/02 |

* cited by examiner

*Primary Examiner*—Mariceli Santiago
(74) *Attorney, Agent, or Firm*—Fitzpatrick, Cella, Harper & Scinto

(57) ABSTRACT

A voltage applying apparatus including a holder, a probe and the like as voltage applying means enabling the application of a voltage to electrode wiring connected with electric conductors formed on a substrate on which the electrode wiring is formed. The apparatus is equipped with aligning means making the position of the probe follow to the changes of the position of the electrode wiring to coincide with them. The aligning means makes the position of the probe follow the position of the electrode wiring so that the probe aligns the electrode wiring by the thermal expansion of the holder.

2 Claims, 10 Drawing Sheets

VOLTAGE APPLYING APPARATUS, AND APPARATUS AND METHOD FOR MANUFACTURING ELECTRON SOURCE

BACKGROUND OF THE INVENTION

1. Field of the Invention

The present invention relates to a voltage applying apparatus suitable for manufacturing an electron source, and an apparatus and a method for manufacturing an electron source.

2. Description of Related Art

Conventionally, as electron-emitting devices, if they are roughly classified, two kinds of them, namely one is a thermion-emitting device and the other is a cold cathode electron-emitting device, are known. The cold cathode electron-emitting device includes a field emission type device, a metal/insulator-layer/metal type device, a surface conduction electron-emitting device and the like.

The surface conduction electron-emitting device utilizes the phenomenon of the occurrence of electron emission caused by an electric current flowing in parallel with a film surface of a small area thin film formed on a substrate. The basic structure, a manufacturing method and the like of the surface conduction electron-emitting device are disclosed in, for example, Japanese Patent Application Laid-Open Nos. 7-235255, 8-171849 and so forth.

The surface conduction electron-emitting device is characterized by a pair of opposed device electrodes and an electroconductive film which are formed on a substrate. The electroconductive film is connected with the pair of the device electrodes, and has an electron-emitting region in a part thereof. A fissure is formed in a part of the electroconductive film.

Moreover, a deposited film having at least either of carbon and a carbon compound as the main component thereof is formed at an end of the fissure.

By arranging a plurality of such electron-emitting devices on the substrate and by connecting each electron-emitting device to each other with wiring, an electron source equipped with a plurality of surface conduction electron-emitting devices can be made.

Moreover, by combining the electron source and a phosphor, a display panel of an image-forming apparatus can be formed.

Conventionally, the manufacturing of such a panel of an electron source has been performed as follows.

That is, as a first manufacturing method, first, an electron source substrate is made. The electron source substrate includes a plurality of devices and wiring connecting the plurality of devices to each other. The plurality of devices and the wiring are formed on the electron source substrate, and the plurality of devices is composed of an electroconductive film and a pair of device electrodes connected with the electroconductive film. Next, the whole of the made electron source substrate is placed in a vacuum chamber. Next, after exhausting the vacuum chamber, a "forming process" is performed by connecting a probe to external terminals (each of the terminals is a part of the wirings disposed on the substrate) and then applying a voltage to the pair of device electrodes through the probe for forming a fissure in the electroconductive film of each of the devices. Moreover, an "activation process" is performed in which a gas containing an organic material is introduced into the vacuum chamber and a voltage is again applied to each of the device electrodes through the probe, as discorsed at "forming process", in an atmosphere containing an organic material to deposit carbon or a carbon compound in the vicinity of the fissure.

Moreover, as a second manufacturing method, first, an electron source substrate is made. The electron source substrate includes a plurality of devices and wiring connecting the plurality of devices to each other. The plurality of devices and the wiring are formed on the electron source substrate, and the plurality of devices is composed of an electroconductive film and a pair of device electrodes connected with the electroconductive film. Next, a panel of an image-forming apparatus is made by joining the made electron source substrate and a substrate on which a phosphor is arranged with a supporting frame put between the electron source substrate and the latter substrate. After that, a "forming process" is performed by firstly exhausting inside the panel through a pipe attached to the panel and secondly connecting a probe to external terminals (each of the terminals is a part of the wirings disposed on the substrate) and then applying a voltage to the pair of device electrodes through the probe for forming a fissure in the electroconductive film of each of the devices. Moreover, an "activation process" is performed in which a gas containing an organic material is introduced into the panel through the exhaust pipe and a voltage is again applied to each of the devices through the probe, as discorsed at "forming process", in an atmosphere containing an organic material to deposit carbon or a carbon compound in the vicinity of the fissure.

SUMMARY OF THE INVENTION

Although the above-mentioned manufacturing methods have been practiced, the first manufacturing method requires a larger vacuum chamber and an exhausting apparatus capable of dealing with a high vacuum state as the electron source substrate becomes larger especially. Moreover, the second manufacturing method needs a long time for exhausting the space in the panel of the image-forming apparatus and for introducing the gas containing an organic material.

Moreover, when a probe is contacted with the substrate, namely when electrical processing is performed, the substrate is expanded or shrunk owing to the heat generated by a flowing electric current, and then the position of the electrode wiring on the substrate changes. Consequently, a discrepancy is produced between the position of the electrode wiring and a probe contacting part, and thereby a crack or a damage of the substrate and a damage of the probe are produced in some cases, or it becomes impossible for the tip of the probe to contact with the electrode wiring in other cases. These cases especially occur in the above-mentioned "activation process" in many cases. Because a carbon film is not deposited in the gap formed at the "forming process" yet at the initial stage of the "activation process", the electric current flowing between the pair of device electrodes is small. However, the electric current flowing between the pair of device electrodes increases as the carbon film is gradually deposited (as the activation advances). FIG. 13 typically shows a change of an electric current (device current $I_f$) flowing between a pair of device electrodes with the passage of time at the time of the "activation process". As the device current $I_f$ changes agedly in such a way, the Joule heat generated on the surface of the substrate is changed to rise. Thereby, the problem mentioned above is notably produced in the "activation process" rather than in the "forming process".

Accordingly, the present invention aims to provide a voltage applying apparatus and an apparatus for manufacturing an electron source, both being capable of being shaped to be small in size and of simplifying their operationality, and further capable of decreasing failures owing to cracks or fractures of a substrate to make it possible to achieve the improvement of the durability and an electroconductive property of voltage applying means.

Moreover, the present invention aims to provide an apparatus and a method for manufacturing an electron source which can improve their manufacturing speeds and are suitable for the mass production of the electron source.

Moreover, the present invention aims to provide an apparatus and a method for manufacturing an electron source which can manufacture an electron source having a superior electron-emitting characteristic.

For attaining the above-mentioned objects, the present invention is a voltage applying apparatus including voltage applying means enabling voltage application to electrode wiring formed on a substrate to be connected with an electric conductor formed on the substrate, the apparatus comprising aligning means for making a position of the voltage applying means follow to a change of a position of the electrode wiring so that the voltage applying means aligns the electrode wiring. The voltage applying apparatus can be applied as means for processing an electron source formed on the electrode wiring to be connected with it by applying a voltage to the electrode wiring, and for measuring a breaking, a short circuit and a resistance value of the electrode wiring.

Moreover, it is preferable that the aligning means of a voltage applying apparatus of the present invention makes the position of the voltage applying means follow to the change of the position of the electrode wiring so that the voltage applying means aligns the electrode wiring by means of thermal expansion of the voltage applying means.

Moreover, it is preferable that the voltage applying means of a voltage applying apparatus according to the present invention is provided with a mechanism for cooling and heating.

Moreover, the voltage applying means of a voltage applying apparatus according to the present invention may have a structure made by fabricating a block holding feeding means, a block including heating means and a block including cooling block, each of the blocks being separated from each other.

Moreover, it is preferable that a difference between a thermal expansion coefficient of the voltage applying means of a voltage applying apparatus according to the present invention and a thermal expansion coefficient of the substrate is $1\times10^{-5}$ or less.

Moreover, an apparatus for manufacturing an electron device according to the present invention may include a supporting medium supporting a substrate on which an electric conductor is formed, a container having a feed port of a gas and an exhaust port of the gas, the container covering a region being a part of the surface of the substrate, means for introducing the gas into the container, the means being connected with the feed port of the gas, means for exhausting the container, the means being connected with the exhaust port of the gas, and means for applying a voltage to the electronic conductor.

Moreover, an apparatus for manufacturing an electron source according to the present invention may have a structure for making the position of the voltage applying means follow to a change of the position of the electrode wiring to coincide with it in the aforementioned apparatus for manufacturing an electron source.

Moreover, an apparatus for manufacturing an electron source may have a structure for making the position of the voltage applying means follow to a change of the position of the electrode wiring to coincide with it by the thermal expansion of the voltage applying means in the aforementioned apparatus for manufacturing an electron source.

Moreover, the voltage applying means of an apparatus for manufacturing an electron source according to the present invention may have a structure made by fabricating a block holding feeding means, a block having heating means, and a block having cooling means, each of the blocks being separated from each other, in the aforesaid apparatus for manufacturing an electron source.

Moreover, an apparatus for manufacturing an electron source according to the present invention may have a structure in which a difference between the thermal expansion coefficient of the voltage applying means and the thermal expansion coefficient of the substrate is $7\times10^{-6}$ or less.

The present invention is described in the following further in detail.

A concrete manufacturing apparatus according to the present invention is first equipped with a supporting medium for supporting a substrate on which an electric conductor is previously formed, and a container covering the substrate supported by the supporting medium. Hereupon, the container covers a region being a part of the surface of the substrate, and thereby it becomes possible to form an airtight space on the substrate in the state in which a part of wiring formed on the substrate to be connected with the electric conductor on the substrate is exposed to the outside of the container. Moreover, a feed port of a gas and an exhaust port of the gas are provided on the container, and means for introducing the gas into the container and means for exhausting the gas from the container are connected to the feed port and the exhaust port, respectively. Thereby, the inside of the container can be set to be a desired atmosphere. Moreover, the substrate on which the electric conductor has been formed previously means a substrate to be an electron source by forming an electron-emitting portion in the electric conductor by processing the electric conductor electrically. Consequently, the manufacturing apparatus according to the present invention may further be equipped with means for processing electric processing, for example, means for applying a voltage to the electric conductor.

The manufacturing apparatus described above can achieve the miniaturization thereof by being equipped with any one of the voltage applying apparatus described above, and can achieve the simplification of the operationality such as the electric connection with a power source in the electric processing. Furthermore, the degree of freedom of designing the largeness and the shape of the container and the like increases, and it becomes possible to perform the introduction of a gas into the container and the exhaustion of a gas to the outside of the container in a short time.

Moreover, a method for manufacturing an electron source according to the present invention first arranges a substrate having an electric conductor and wiring connected with the electric conductor, both having been formed previously on the substrate, on a supporting medium, and the method covers the electric conductor on the substrate with a container except a part of the wiring. Thereby, in the state in which a part of the wiring formed on the substrate is exposed to the outside of the container, the electric conductor is arranged in an airtight space formed on the substrate. Next, the method makes the inside of the container to be a desired atmosphere. The method then performs electrical processing of the electric conductor, for example the application of a voltage to the electric conductor, through the part of the wiring exposed to the outside of the container. Hereupon, the desired atmosphere means, for example, a decompressed atmosphere or an atmosphere in which a prescribed gas exists. Moreover, the electric processing means the processing for forming an electron-emitting portion in the electric conductor to make the electron-emitting portion to be an electron source. Moreover, there is a case where the electric processing is performed in different atmospheres a plurality of times. For example, the method covers the electric conductor with the container except a part of the wiring. And the method first performs a process for executing the electric processing by setting the inside of the container to be a first atmosphere. Next, the method performs a process for executing the electric processing by setting the inside of the container to be a second atmosphere. Thereby, the method forms a good electron-emitting portion in the electric conductor, and the electron source has been manufactured. Hereupon, the first atmosphere is preferably a decompressed atmosphere, and the second atmosphere is preferably an atmosphere in which a specific gas such as a carbon compound exists, which will be described later.

In the manufacturing method described above, by the use of an apparatus for manufacturing an electron source equipped with the voltage applying apparatus described above, it becomes possible to perform the electrical connection with a power source in the electric processing or the like easily. Moreover, because the degree of freedom of designing the largeness, the shape and the like of the container increases, the introduction of a gas into the container and the exhaustion of the gas to the outside of the container can be performed in a short time, which improves the manufacturing speed of an electron source. In addition, the reproducibility of the electron-emitting characteristic of the electron source to be manufactured, especially the uniformity of the electron-emitting characteristics of an electron source having a plurality of electron-emitting portions are improved.

BRIEF DESCRIPTION OF THE DRAWINGS

FIG. 1 is a sectional view showing the structure of an apparatus for manufacturing an electron source according to a first embodiment of the present invention and a connection diagram of a pipe arrangement and the like;

FIG. 3 is a sectional view showing the structure of an apparatus for manufacturing an electron source according to a second embodiment of the present invention and a connection diagram of a pipe arrangement and the like;

FIG. 6 is a sectional view showing the structure of an apparatus for manufacturing an electron source according to another embodiment of the present invention and a connection diagram of a pipe arrangement and the like;

DESCRIPTION OF THE PREFERRED EMBODIMENTS

Next the preferred embodiments of the present invention are shown.

Figure 1:
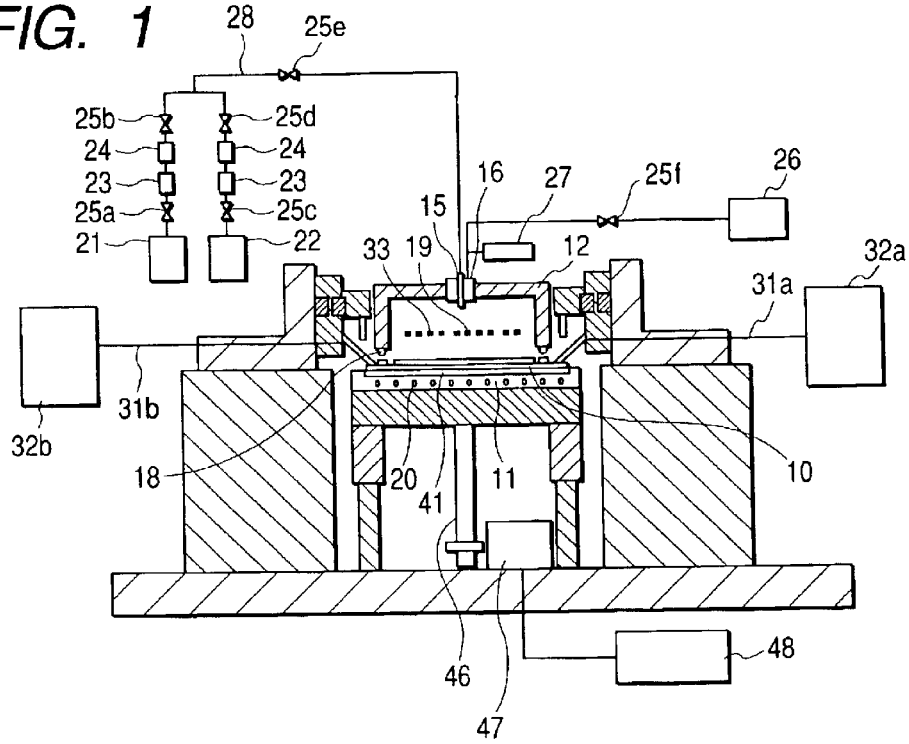
Figure 2:
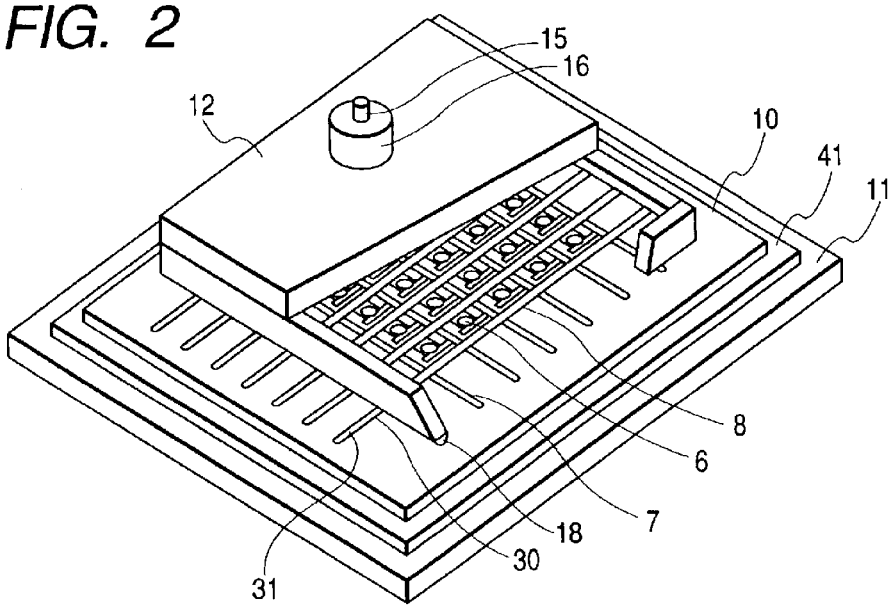
FIG. 2 is an oblique perspective view showing peripheral parts of an electron source substrate in FIGS. 1 and 3 in a state of being partially broken.
Figure 3:
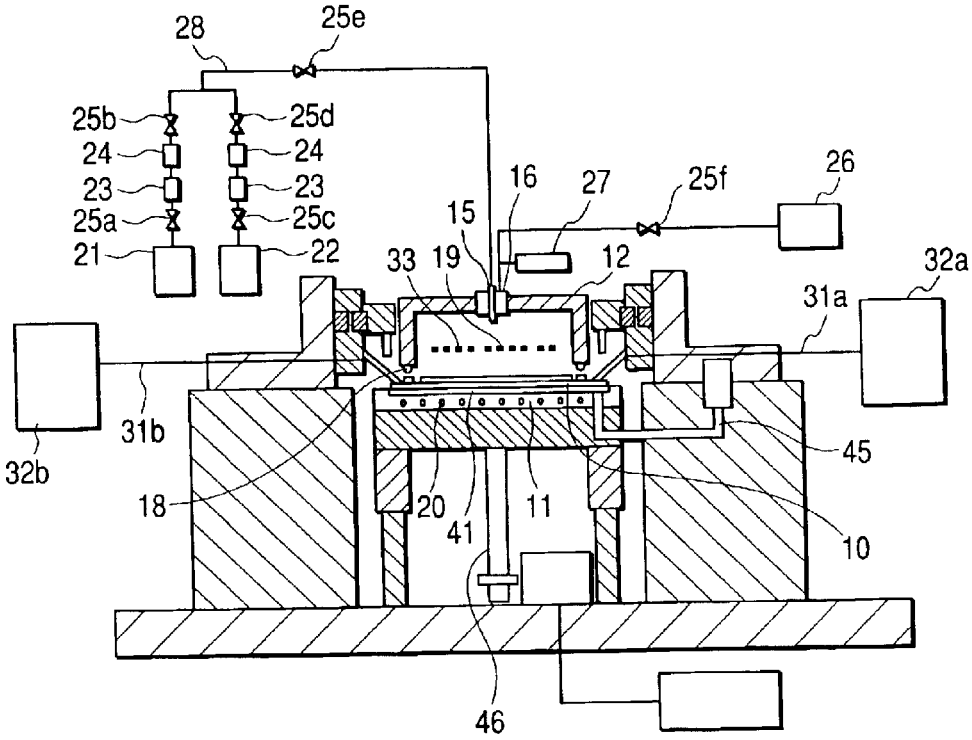

FIGS. 1, 2 and 3 show apparatus for manufacturing an electron source according to embodiments of the present invention. FIG. 1 is a sectional view showing the structure of an apparatus for manufacturing an electron source according to a first embodiment of the present invention and a connection diagram of a pipe arrangement and the like, and FIG. 2 is an oblique perspective view showing peripheral parts of an electron source substrate in FIGS. 1 and 3. Moreover, FIG. 3 is a sectional view showing the structure of an apparatus for manufacturing an electron source according to a second embodiment of the present invention and a connection diagram of a pipe arrangement and the like.

In FIGS. 1, 2 and 3, a reference numeral 6 designates electric conductors to be formed as electron-emitting devices; a reference numeral 7 designates wiring in an X direction; a reference numeral 8 designates wiring in a Y direction; a reference numeral 10 designates an electron source substrate; a reference numeral 11 designates a supporting medium for supporting the electron source substrate 10; a reference numeral 12 designates a vacuum chamber; a reference numeral 15 designates a feed port of a gas into the vacuum chamber 12; a reference numeral 16 designates an exhaust port; a reference numeral 18 designates a sealing member arranged between the supporting medium 11 and the vacuum chamber 12; a reference numeral 19 designates a diffuser panel arranged in the vacuum chamber 12; a reference numeral 20 designates a heater provided in the supporting medium 11; a reference numeral 21 designates hydrogen or an organic material gas contained in a container; a reference numeral 22 designates a carrier gas contained in a container; a reference numeral 23 designates a filter for removing moisture; a reference numeral 24 designates a gas flow rate control apparatus; reference numerals 25*a*, 25*b*, 25*c*, 25*d*, 25*e* and 25*f* severally designate a valve; a reference numeral 26 designates a vacuum pump; a reference numeral 27 designates a vacuum gage; a reference numeral 28 designates a pipe arrangement; a reference numeral 30 designates fetch wiring; a reference numeral 32 (32*a* or 32*b*) designates a driving driver composed of a power source and a current controlling system; a reference numeral 31 (31*a* or 31*b*) designates wiring for connecting the fetch wiring 30 with the driving driver 32; a reference numeral 33 designates opening portions of the diffuser panel 19; a reference numeral 41 designates a heat conduction member; a reference numeral 46 designates an elevating shaft; a reference numeral 47 designates an elevation driving unit for elevating the supporting medium 11; a reference numeral 48 designates an elevation controlling apparatus for controlling the elevation of the supporting medium 11; and a reference numeral 48 designates an elevation controlling apparatus for controlling the elevation of the supporting medium 11.

The supporting medium 11 is for holding and fixing the electron source substrate 10 at a prescribed position. The supporting medium 11 has a mechanism for fixing the electron source substrate 10 mechanically by a vacuum chucking mechanism, an electrostatic chucking mechanism, a fixing jig or the like. The supporting medium 11 is provided with the heater 20 in the inside thereof, and thereby the supporting medium 11 can heat the electron source substrate 10 through the heat conduction member 41 as the need arises.

The heat conduction member 41 is located on the supporting medium 11. The heat conduction member 41 may be nipped between the supporting medium 11 and the electron source substrate 10, or may be located to be embedded into the supporting medium 11 so as not to be an obstacle to hold and fix the electron source substrate 10.

The heat conduction member 41 absorbs a warp and the undulation of the electron source substrate 10. The heat conduction member 41 can transmit generated heat in an electric processing process for the electron source substrate 10 to the supporting medium 11 surely to radiate the heat. Consequently, the heat conduction member 41 can prevent the generation of cracks and damages of the electron source substrate 10, and thereby can contribute to improve the yield of the electron source.

Moreover, the method for manufacturing an electron source radiates the heat generated at the electronic processing process quickly and surely, and thereby the method can contribute to decrease the concentration distribution of an introduced gas and to decrease the ununiformity of electron-emitting devices to which the heat distribution of the substrate influences. Consequently, the method makes it possible to manufacture electron sources having superior uniformity.

The heat conduction member 41 can be formed by the use of a viscous liquid material such as silicone grease, silicone oil and a gel material. If there is the evil of the movement of the heat conduction member 41, being a viscous liquid material, on the supporting medium 11, the supporting medium 11 may be provided with a staying mechanism in order that the viscous liquid material may stay within a prescribed position and a region, namely stay at least in a region where the electric conductors 6 of the electron source substrate 10 are formed. The staying mechanism is formed to fit with the region. The staying mechanism can be structured as, for example, a heat conduction member composed of the viscous liquid material placed in an O-ring or a heat-resisting bag being sealed up.

For avoiding a state in which the viscous liquid material does not correctly contact with the electron source substrate 10 and the supporting medium 11 owing to an air layer formed between them in the case where the viscous liquid material is stayed by means of the provided O-ring or the like, the heat conduction member 41 may be structured with a through hole for bleeding air or be structured by adopting a method in which the viscous liquid material is injected between the electron source substrate 10 and the supporting medium 11 after the provision of the electron source substrate 10.

FIG. 3 is a schematic sectional view showing a manufacturing apparatus according to the second embodiment of the present invention. The manufacturing apparatus is provided with an O-ring and an introducing pipe 45 communicating to the introducing opening of the viscous liquid material for staying the viscous liquid material within a prescribed region.

If a mechanism for nipping the viscous liquid material between the supporting medium 11 and the electron source substrate 10 and for controlling the temperature of the viscous liquid material while circulating the viscous liquid material is provided for the viscous liquid material, the mechanism and the viscous liquid material function as heating means or cooling means of the electron source substrate 10 in place of the heater 20. Moreover, by means of the mechanism and the viscous liquid material, the temperature control of the electron source substrate 10 to an aimed temperature can be performed. For example, a mechanism composed of a circulation type temperature adjusting apparatus and a liquid medium can be provided.

The heat conduction member 41 may be an elastic member. The elastic member can be formed by the use of a synthetic resin material such as a Teflon resin, a rubber material such as silicon rubber, a ceramic material such as alumina, a metal material such as copper and aluminum, or the like as its material. These materials may be used in a sheet state or a divided sheet state. Or, a columnar body such as a cylindrical body and a prismatic body, a linear body elongated in an X direction or a Y direction in accordance with the wiring on the electron source 10, a protruding body such as a cone, a conglobation body such as a sphere and a Rugby ball (a spheroid), a conglobation body in the shape of a conglobation body with a projection on its surface, or the like may be provided on the supporting medium 11.

The vacuum chamber 12 is a container made of glass or stainless steel. It is preferable that the vacuum chamber 12 is made of a material making the vacuum chamber 12 discharge little gas. The vacuum chamber 12 is aligned to the electron source substrate 10 to be arranged. The vacuum chamber 12 covers the region where the electric conductors 6 are formed except the fetch wiring portion of the electron source substrate 10, and is structured to be able to endure a pressure within a range at least from $1.33\times10^{-1}$ Pa ($1\times10^{-3}$ Torr) to the atmospheric pressure.

The sealing member 18 is for holding the airtightness between the electron source substrate 10 and the vacuum chamber 12. An O-ring or a sheet made of rubber is used as the sealing member 18.

As the organic material gas 21, organic materials to be used for the "activation process" of the electron-emitting devices, which will be described later, or a mixed gas composed of one of the organic materials and a gas such as a nitrogen gas, a helium gas, an argon gas or the like for diluting the organic material are used. Moreover, when conduction processing for forming, which will be described later, is performed, it is also possible to introduce a gas for urging the formation of a fissure (or a gap) of an electroconductive film, for example, a hydrogen gas having a reduction property or the like into the inside of the vacuum chamber 12. In the case where a gas is introduced at another process as above, a gas introducing system for that may be usable by connecting the vacuum chamber 12 with the pipe arrangement 28 by the use of an introducing pipe arrangement and a valve 25*e*.

The following organic materials can be used as the organic material for the "activation process" of the electron-emitting devices. That is, aliphatic hydrocarbons such as alkane, alkene and alkyne, aromatic hydrocarbons, alcohols, aldehyde, ketone, amines, nitrile, and organic acids such as phenol, carvone and a sulfonic acid can be cited. To put it more concretely, saturated hydrocarbons which can, be expressed by a composition formula of $C_nH_{2n+2}$ such as methane, ethane and propane, unsaturated hydrocarbons which can be expressed by a composition formula of $C_nH_{2n}$ such as ethylene and propylene, benzene, toluene, methanol, ethanol, acetaldehyde, acetone, methyl ethyl ketone, methylamine, ethylamine, phenol, benzonitrile, acetonitrile and the like can be used.

If the organic material in the organic material gas 21 is a gas at an ordinary temperature, the organic material gas 21 can be used as it is. If the organic material in the organic material gas 21 is a liquid or a solid at an ordinary temperature, the organic material is used by means of methods in which the organic material is vaporized or sublimed in the container, or in which the organic material is further mixed with a diluent gas. An inert gas such as a nitrogen gas, an argon gas, a helium gas and the like is used as the carrier gas 22.

The organic material gas 21 and the carrier gas 22 are mixed at a fixed ratio to be introduced into the vacuum chamber 12. The flow rates and the mixture ratios of both of the organic material gas 21 and the carrier gas 22 are controlled by the gas flow rate control apparatus 24. The gas flow rate control apparatus 24 is composed of a massflow controller, an electromagnetic valve and the like. The mixed gas is heated to a suitable temperature by a not shown heater provided around the pipe arrangement 28 as the need arises, and after that the mixed gas is introduced into the vacuum chamber 12 through the feed port 15. It is preferable that the heating temperature of the mixed gas is made to be the same as the temperature of the electron source substrate 10.

Incidentally, it is more preferable that the filter for removing moisture 23 is provided in the middle of a branch pipe of the pipe arrangement 28 to remove the moisture in the introduced gas. The filter for removing moisture 23 can be structured by the use of an absorbent material such as silica gel, molecular sieve and magnesium hydrate.

The mixed gas introduced into the vacuum chamber 12 is evacuated from the vacuum chamber 12 through the exhaust port 16 at a fixed evacuation speed by the vacuum pump 26. Thereby, the pressure of the mixed gas in the vacuum chamber 12 is kept to be constant. A low vacuum pump which is a oil free pump such as a dry-sealed vacuum pump, a diaphragm pump and a scroll pump is preferably used as the vacuum pump 26 used in the present embodiment.

Although it depends on the kind of an organic material to be used for the "activation process", it is preferable that the pressure of the mixed gas is equal to or more than a pressure at which the mean free path $\lambda$ of the gas molecules constituting the mixed gas is sufficiently smaller than the size of the inside of the vacuum chamber 12 in the present embodiment from the points of view of the shortening of the time of an "activation process" and the improvement of uniformity. The pressure is within the so-called viscous flow region, or the pressure within a range from several hundreds Pa (several Torr) to the atmospheric pressure.

Moreover, if the diffuser panel 19 is provided between the gas feed port 15 of the vacuum chamber 12 and the electron source substrate 10, the flow of the mixed gas is controlled, and then the organic material is fed to the whole surface of the electron source substrate 10. Thereby the uniformity of the electron-emitting devices is improved. Accordingly, it is preferable to provide the diffuser panel 19.

The fetch wiring 30 of the electron source substrate 10 is arranged on the outside of the vacuum chamber 12. The fetch wiring 30 is connected with the wiring 30 by means of TAB wiring, a probe 611 shown in FIG. 4, or the like. The fetch wiring 30 is then connected with the driver 32.

In the present embodiment, or also similarly in another embodiment which will be later, because it is sufficient for the vacuum chamber 12 to cover only the electric conductors 6 on the electron source substrate 10, it is possible to miniaturize the apparatus. Moreover, because a part of the wiring of the electron source substrate 10 is arranged on the outside of the vacuum chamber 12, electrical connection of the electron source substrate 10 with a power source apparatus (the driver 32) for performing electrical processing can easily be performed.

In such a way, the manufacturing apparatus according to the present embodiment can activate the electron-emitting devices 6 by applying pulse voltages to the electric conductors to be formed as the electron-emitting devices 6 on the substrate 10 through the wiring 31 by means of the driver 32 in the state of making the mixed gas including the organic material flow in the vacuum chamber 12.

As for concrete examples of a method for manufacturing an electron source by the use of the manufacturing apparatus described above, the examples are described in the following in detail.

Figure 8:
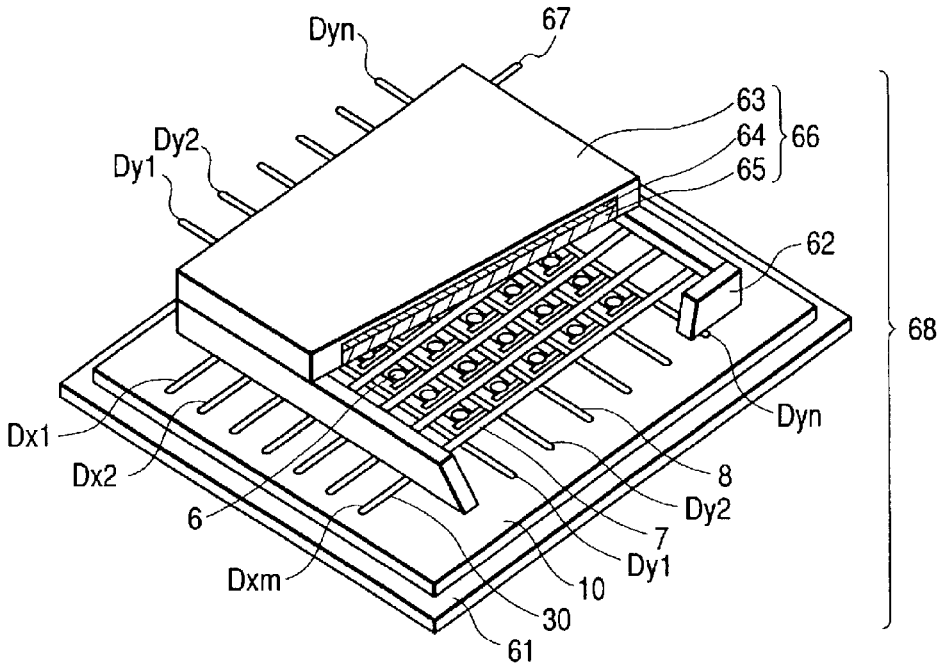
FIG. 8 is an oblique perspective view showing the structure of an image-forming apparatus according to an example of the present invention in a state of being partially broken.

An image-forming apparatus 68 shown in FIG. 8 can be formed by combining the above-mentioned electron source and image-forming members. FIG. 8 is a schematic diagram of the image-forming apparatus 68. In FIG. 8, the reference numeral 6 designates electron-emitting devices; a reference numeral 61 designates a rear plate on which the electron source substrate 10 is fixed; and a reference numeral 62 designates a supporting frame. A reference numeral 66 designates a face plate composed of a glass substrate 63, a metal back 64 and a phosphor 65; a reference numeral 67 designates a high voltage terminal; and the reference numeral 68 designates the image-forming apparatus.

The image-forming apparatus 68 makes each of the electron-emitting devices 6 emit electrons by applying a scanning signal and a modulating signal severally by not shown signal generating means through external container terminals in the X direction $D_{x1}$ to $D_{xm}$ and external container terminals in the Y direction $D_{y1}$ to $D_{yn}$. Then, the image-forming apparatus 68 applies a high voltage of 5 kV to the metal back 64 or a not shown transparent electrodes through the high voltage terminal 67 to accelerate electron beams. And the image-forming apparatus 68 collides the accelerated electron beams with the phosphor 65 to excite it. Thereby, the image-forming apparatus 68 makes the phosphor 65 emit light to display an image.

Incidentally, there is a case where the electron source substrate 10 itself acts as the rear plate 61 also and the image-forming apparatus 68 is composed of one sheet of substrate.

Moreover, the wiring for scanning signals may be the wiring for scanning arranged only on one side as shown in FIG. 8 if the image-forming apparatus 68 has the number of devices which does not cause any influences between an electron-emitting device 6 among the electron-emitting devices 6 nearest to the external container terminals $D_{x1}$ and so forth and an electron-emitting device among them farthest to the external container terminals $D_{x1}$ and so forth. However, in the case where the image-forming apparatus 68 has a large number of devices and the influence of the decrease of voltages is caused, it is possible to adopt measures such as widening the width of the wiring, thickening the thickness of the wiring or applying a voltage from both sides.

The present invention especially concerns the part of voltage applying means (the probe, the holder thereof and the like) in the embodiments described above. In particular, the present embodiments solve the problems such that a crack or a damage of the substrate 10 and a damage of the probe are produced in some cases, or that it becomes impossible for the tip of the probe to contact with the electrode wiring in other cases. The problems are caused by the following reasons. That is, when the probe is contacted with the substrate 10, namely when electrical processing is being performed, the substrate 10 is expanded or shrunk owing to the heat generated by a flowing electric current, and then the position of the electrode wiring on the substrate 10 changes. Consequently, a discrepancy is produced between the position of the electrode wiring and a probe contacting part. The discrepancy causes the problems.

In particular, the present embodiments are severally characterized by a structure for making the position of the voltage applying means follow the changes of the position of the electrode wiring for making the positions coincide with each other.

Moreover, the present embodiments are severally characterized by making the position of the voltage applying means follow the changes of the position of the electrode wiring to coincide with the positions to each other by the thermal expansion of the voltage applying means.

Moreover, the present embodiments are severally characterized in that the voltage applying means is provided with a mechanism for heating and cooling.

Moreover, the present embodiments are severally characterized in that the voltage applying means has a structure made by fabricating a block holding feeding means, a block including heating means and a block including cooling block, the blocks being severally separated from each other.

Moreover, the present embodiments are severally characterized in that a difference between the thermal expansion coefficient of the voltage applying means and the thermal expansion coefficient of the substrate is $1\times10^{-5}$ or less.

Moreover, the present embodiments severally remove the failures of the substrate 10 owing to the cracks or the damages thereof to bring about high effects concerning the improvement of the durability of the probe and the improvement of the electroconductive property thereof.

EXAMPLES

In the following, the present invention is described in detail by the use of concrete examples. However, the scope of the present invention is not limited by the examples. The scope of the present invention includes the substitutions of each component and the changes of designs of each component within a range in which the objects of the present invention can be achieved.

Example 1

Figure 4:
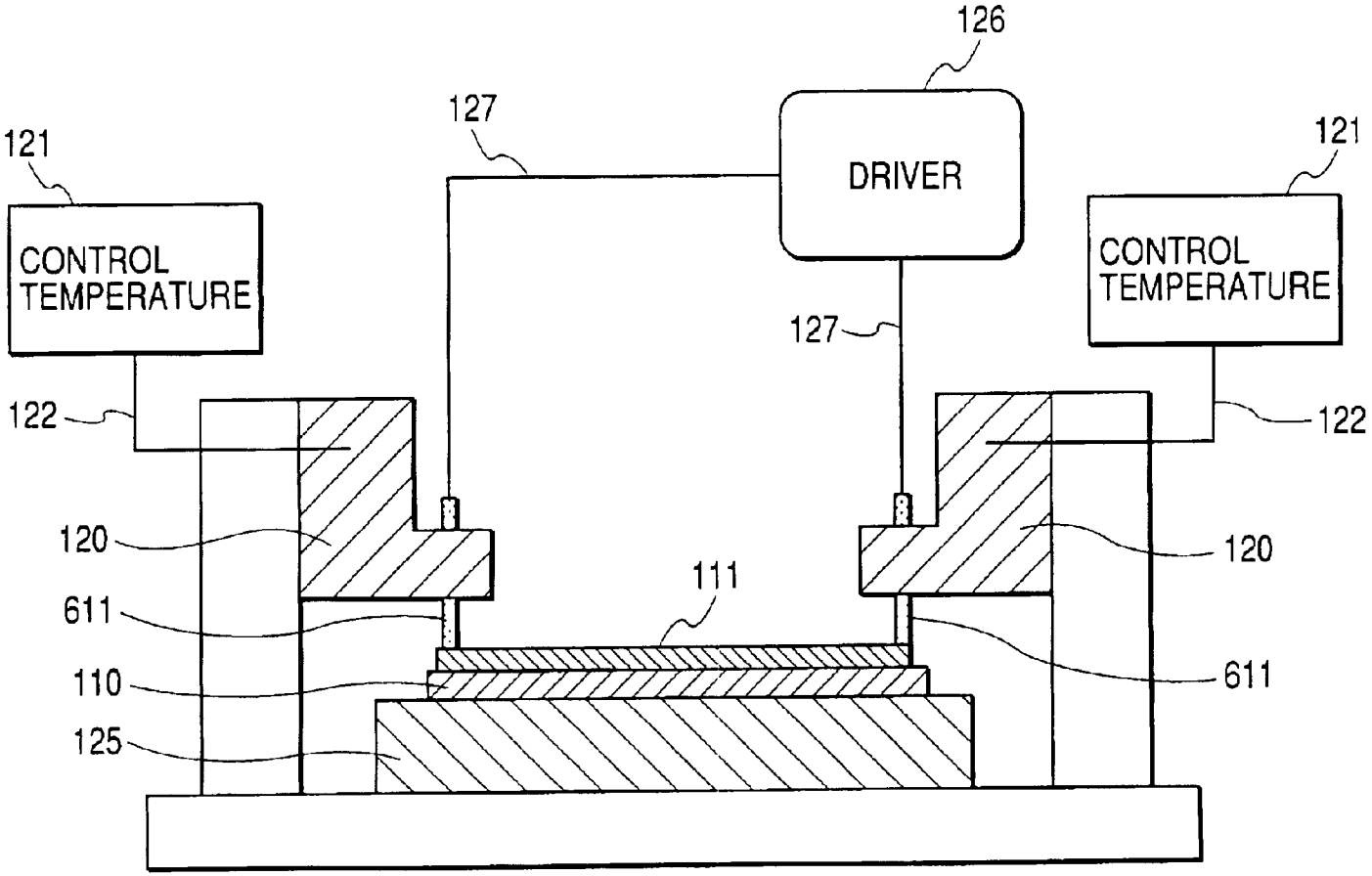
FIG. 4 is a sectional view showing the structure of a voltage applying apparatus according to an embodiment.
Figure 5:
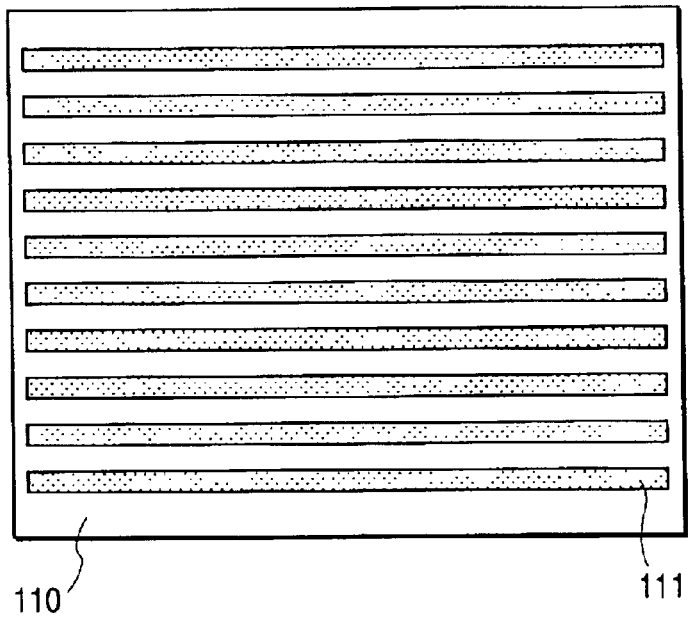
FIG. 5 is a plan view of the substrate shown in FIG. 4.

The present example concerns a voltage applying apparatus for applying a voltage to electric conductors of electrode wiring formed on a substrate, and further concerns the measurement of the breaking of a wiring, a short circuit, the value of resistance. FIG. 4 is a diagram for illustrating an embodiment of a voltage applying apparatus according to the present embodiment. FIG. 5 is a diagram showing a substrate being an object of measurement.

In FIGS. 4 and 5, a reference numeral 110 designates a substrate; a reference numeral 111 designates electrode wiring arranged on the substrate 110; the reference numeral 611 designates the probe for contacting with the electrode wiring 111 to apply an voltage thereto; a reference numeral 120 designates a holder of the probe 611 and voltage applying means provided with a mechanism for heating and cooling; a reference numeral 121 designates a temperature controlling apparatus for performing the control of the temperature of the holder 120 of the voltage applying means; a reference numeral 122 designates a cable for connecting the temperature controlling apparatus 121 and the holder 120 of the voltage applying means; a reference numeral 125 designates a supporting medium for supporting the substrate 110; a reference numeral 126 designates a driver equipped with a power source and a current controlling system for measuring the breaking of a wiring, a short circuit, a value of resistance; and a reference numeral 127 designates a cable connecting the probe 611 with the driver 126.

Hereupon, the substrate 110 is made of soda lime glass, and the thermal expansion coefficient thereof is $7.5\times10^{-6}$/°C. The holder 120 equipped with the probe 611 and the mechanism of heating and cooling is made of stainless steel, and the thermal expansion coefficient thereof is $16\times10^{-6}$/°C.

The electrode wiring 111 was formed by printing Ag paste by the screen printing method and by heating the Ag paste to burn it. The substrate 110 was made by the formation of the electrode wiring 111.

The made substrate 110 was fixed on the supporting medium 125 of the voltage applying apparatus shown in FIG. 4.

Next, the probe 611 was contacted with the electrode wiring 111 to apply a voltage to the electrode wiring 111 by the driver 126 through the cable 127. As for the thermal expansion of the substrate 110 owing to the heat generated by the electric current flowing through the electrode wiring 111 at the time of the application of the voltage, the temperature of the holder 120 of the voltage applying means was regulated by means of the temperature controlling apparatus 121 to change the temperature of the holder 120, and thereby the amounts of the changes of the position of the probe 611 were made to be the same as those of the position of the substrate 110 owing to the thermal expansion, and consequently the position of the probe 611 was made to follow a prescribed position of the substrate 110 to coincide with it. The temperature at this time was controlled in order that the temperature on the side of the substrate 110 and the temperature on the side of the holder 120 holding the probe 611 may be the same.

Thereby, no discrepancy was generated between the fetch wiring 30 and the probe connecting portion. And any crack and any damage of the substrate 110 and any damage of the probe 611 were not produced. Otherwise, there was no case where the tip of the probe 611 did not contact with the electrode wiring 111, and then the durability of the probe 611 could be improved. Furthermore, good measurements of the snapping of a wire, a short circuit, the value of resistance could be realized.

Example 2

Figure 9:
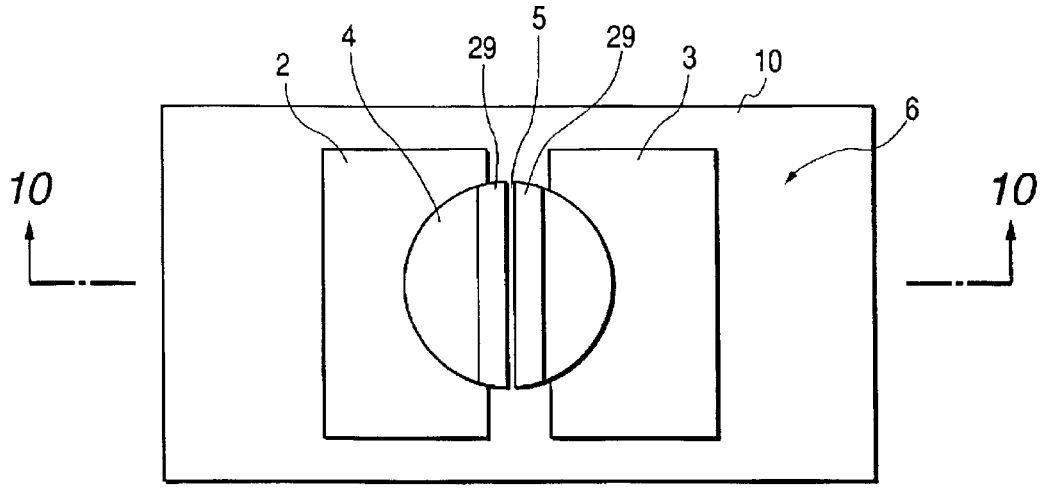
FIG. 9 is a plan view showing the structure of an electron-emitting device according to an example of the present invention.
Figure 10:
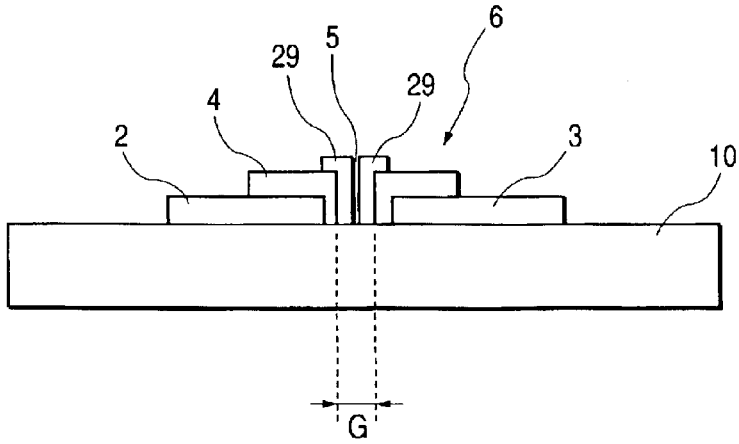
FIG. 10 is a sectional view taken along a line 10—10 in FIG. 9 showing the structure of the electron-emitting device according to the example of the present invention.
Figure 11:
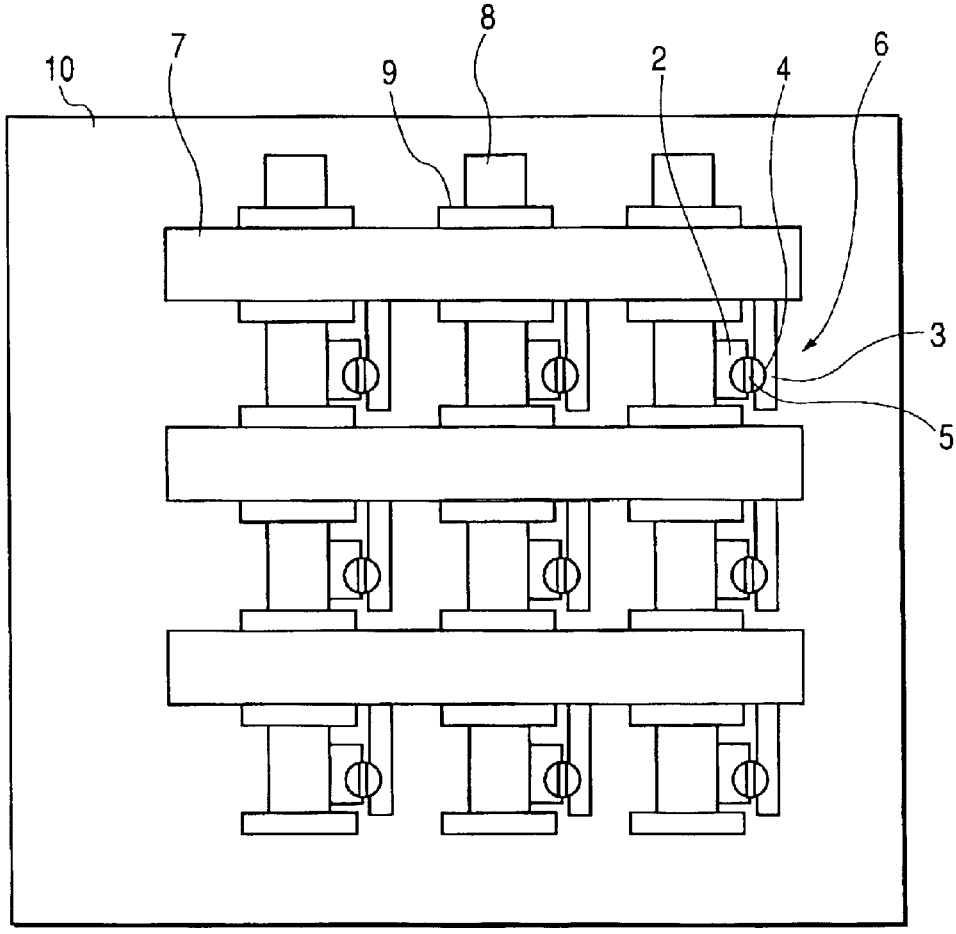
FIG. 11 is a plan view showing an example of an electron source according to an example of the present invention.

An example 2 is an example of manufacturing an electron source shown in FIGS. 8 and 11 equipped with a plurality of surface conduction electron-emitting devices shown in FIGS. 9 and 10 by the use of a manufacturing apparatus according to an embodiment of the present invention in case of not using electrostatic chucking. Incidentally, in FIGS. 8 to 11, the reference numeral 6 designates the electron-emitting devices; the reference numeral 10 designates the electron source substrate; reference numerals 2 and 3 severally designate a device electrode; a reference numeral 4 designates an electroconductive film; a reference numeral 29 designates a carbon film; a reference numeral 5 designates a gap of the carbon film 29, i.e. an electron-emitting portion;

a reference character G designates a gap of the electroconductive film 4; and the reference numeral 30 designates the fetch wiring.

Figure 6:
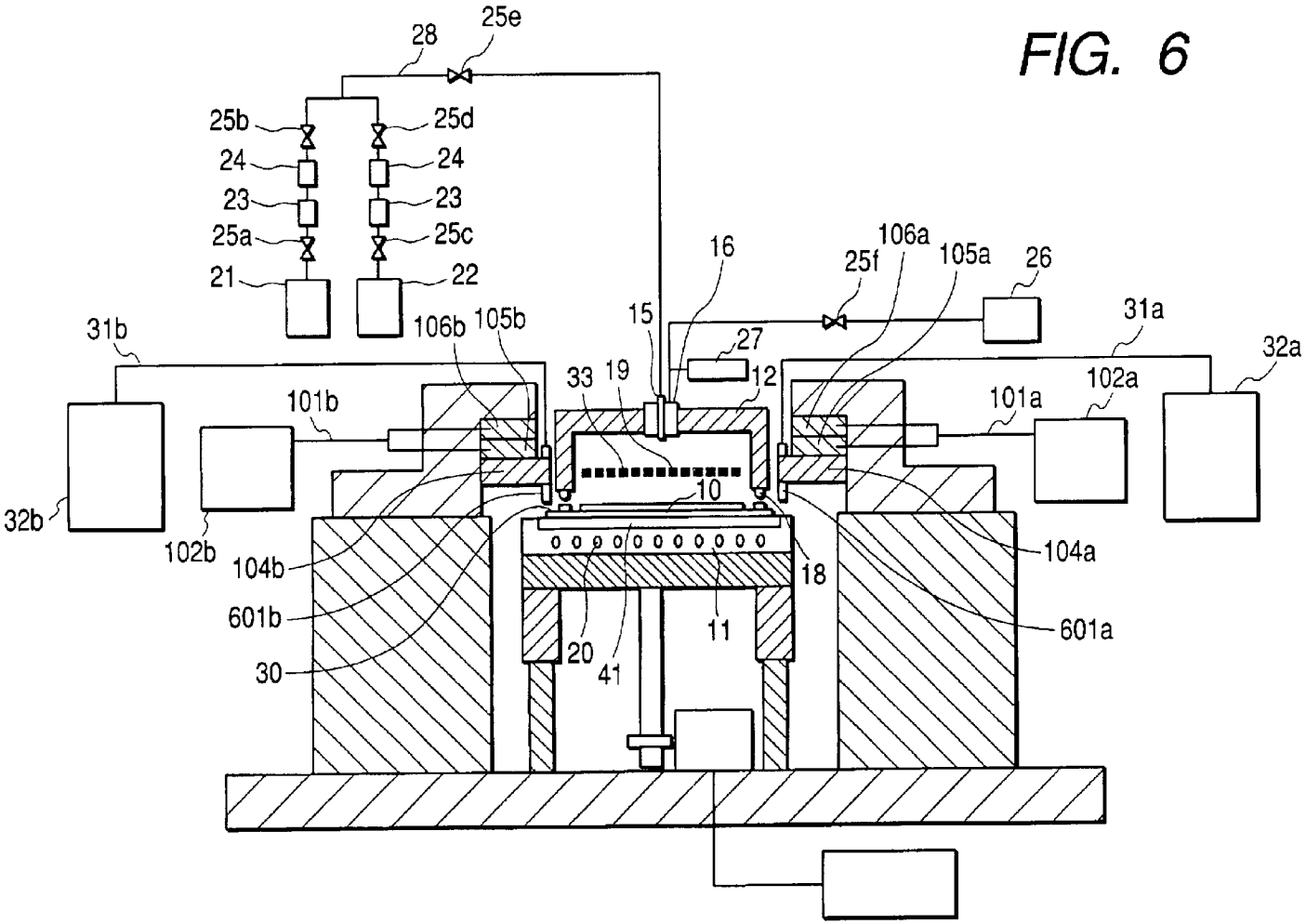
Figure 7:
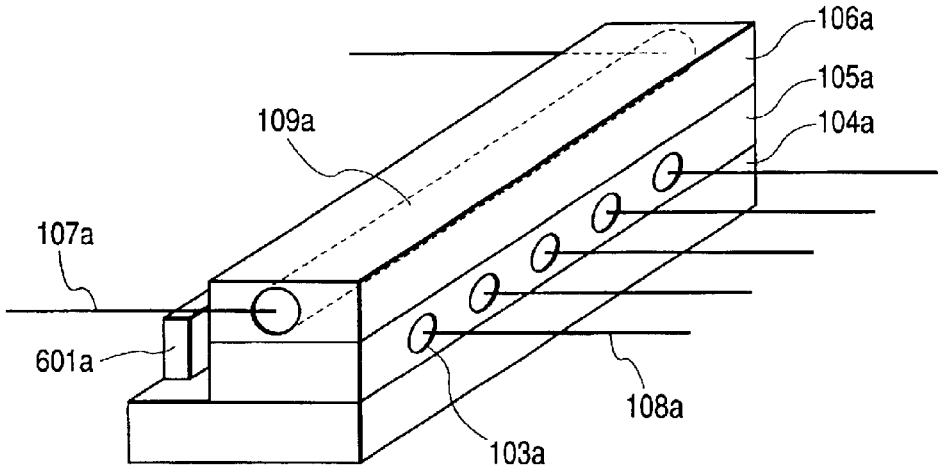
FIG. 7 is an oblique perspective view showing the enlarged principal part of the structure of the voltage applying means shown in FIG. 6.

FIGS. 6 and 7 are diagrams for illustrating an embodiment of a manufacturing apparatus according to the present invention. FIG. 6 is a sectional view showing the whole of the apparatus, and FIG. 7 is an enlarged oblique perspective view showing a part of FIG. 6. The reference numeral 10 designates the electron source substrate; the reference numeral 11 designates the supporting medium; the reference numeral 12 designates a vacuum chamber; the reference numeral 15 designates the feed port of a gas; the reference numeral 16 designates the exhaust port; the reference numeral 18 designates the sealing member; the reference numeral 19 designates the diffuser panel; the reference numeral 20 designates the heater; the reference numeral 21 designates hydrogen or an organic material gas contained in a container; the reference numeral 22 designates a carrier gas contained in a container; the reference numeral 23 designates the filter for removing moisture; the reference numeral 24 designates the gas flow rate control apparatus; the reference numerals 25*a*–25*f* severally designate the valve; the reference numeral 26 designates the vacuum pump; the reference numeral 27 designates the vacuum gage; the reference numeral 28 designates the pipe arrangement; the reference numeral 30 designates the fetch wiring; the reference numeral 32 (32*a* or 32*b*) designates the driver composed of the power source and the current controlling system; the reference numeral 33 designates the opening portions of the diffuser panel 19; the reference numeral 41 designates the heat conduction member; a reference numeral 601 (601*a* or 601*b*) designates a probe contacting with the fetch wiring 30 of the electron source substrate 10 to apply a voltage thereto; and the reference numeral 31 (31*a* or 31*b*) designates a cable for connecting the probe 601 (601*a* or 601*b*) with the driving driver 32 (32*a* or 32*b*).

Moreover, a reference numeral 104 (104*a* or 104*b*) designates a block holding the probe 601 contacting with the fetch wiring 30 of the electron source substrate 10 to apply a voltage thereto; a reference numeral 105 (105*a* or 105*b*) designates a block holding a heater 103 (103*a* or 103*b*); and a reference numeral 106 (106*a* or 106*b*) designates a block including a cooling pipe 109 (109*a* or 109*b*). Reference numerals 108 (108*a* or 108*b*), 107 (107*a* or 107*b*) and 101 (101*a* or 101*b*) designate cables connecting a temperature controller 102 (102*a* or 102*b*) with the block 105 and the block 106.

The electron source substrate 10 is made of soda lime glass, and the thermal expansion coefficient thereof is $7.5\times10^{-6}$/°C. The material of the block 104 holding the probe 601 contacting with the fetch wiring 30 of the electron source substrate 10 to apply a voltage thereto, the block 105 including the heater 103 (103*a* or 103*b*) and the block 106 including the cooling pipe 109 (109*a* or 109*b*) is METAL MATRIX COMPOSITES (made by Celanx, Inc.; the name of the article is PS170), and the thermal expansion coefficient thereof is $6.2\times10^{-6}$/°C.

The device electrodes 2 and 3 shown in FIGS. 9 to 12 were formed by printing Pt paste on the glass substrate 10 by the offset printing method and by heating the Pt paste to burn it. Moreover, the wiring in the X direction 7 (240 pieces) and the wiring in the Y direction 8 (720 pieces), both being shown in FIGS. 11 and 12, were formed by printing Ag paste by the screen printing method and by heating the Ag paste to burn it. Insulating layers 9 at intersection portions of the wiring in the X direction 7 and the wiring in the Y direction 8 were formed by printing insulating past by the screen printing method and by heating the insulating paste to burn it.

Figure 12:
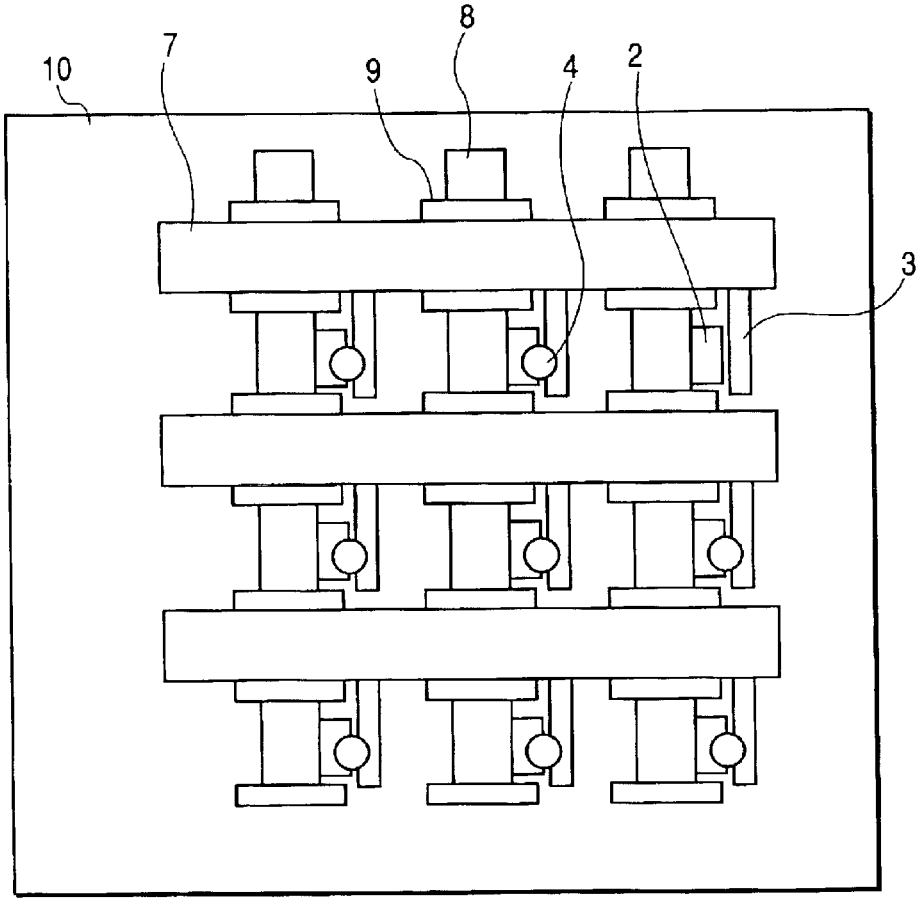
FIG. 12 is a plan view for illustrating a method for manufacturing an electron source according to an example of the present invention.
Figure 13:
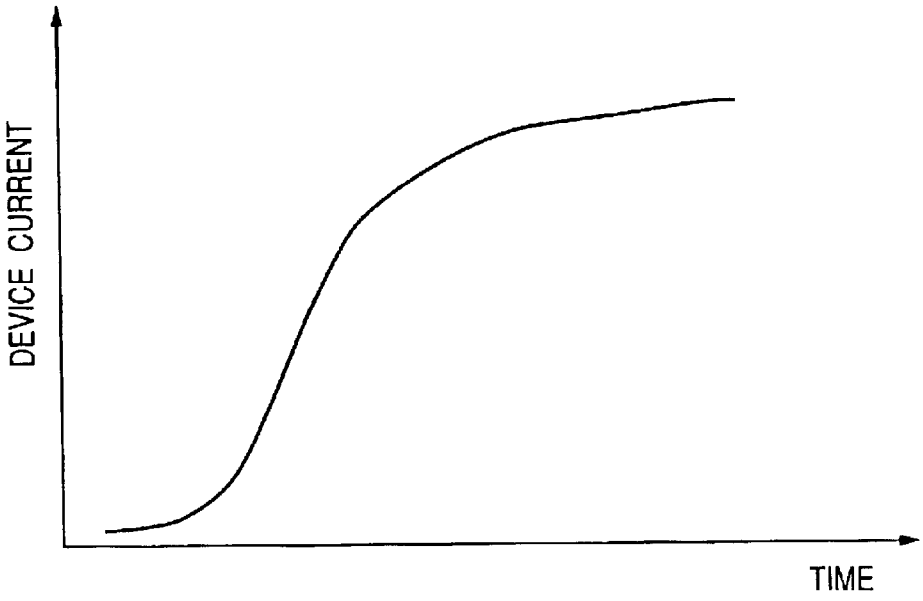
FIG. 13 is a pattern diagram for illustrating a change of a device current according to time at the time of activation processing.

Next, the electroconductive films 4, which were made of palladium monoxide and were shown in FIG. 12, were formed by dropping a palladium complex solution between the device electrodes 2 and 3 by the use of bubble jet type fuel injection equipment and by heating the dropped palladium complex solution. In such a way, the electron source substrate 10 was made on which a plurality of electric conductors 6 composed of a pair of device electrodes 2 and 3 and the electroconductive film 4 severally were wired in an matrix with the wiring in the X direction 7 and the wiring in the Y direction 8.

The made electron source substrate 10 was fixed on the supporting medium 11 of the apparatus for manufacturing an electron source shown in FIG. 2. The heat conduction member 41 was nipped between the supporting medium 11 and the electron source substrate 10.

Next, as shown in FIG. 2, the vacuum chamber 12 made of stainless steel was placed on the electron source substrate 10 with the sealing member 18 which is made of silicone rubber and put between the vacuum chamber 12 and the electron source substrate 10. The vacuum chamber 12 was placed in the way in which the fetch wiring 30 was located on the outside of the vacuum chamber 12.

The valve 25*f* on the side of the exhaust port 16 was opened. The vacuum chamber 12 was exhausted by the vacuum pump 26 (a scroll pump here) to be about $1.33\times10^{-1}$ Pa ($1\times10^{-3}$ Torr). After that, for removing the moisture to be considered to be attached to the pipe arrangement of the exhausting apparatus and the electron source substrate 10, the temperatures of the pipe arrangement and the electron source substrate 10 were raised to be held for several hours in that state and then the temperatures were gradually cooled down to the room temperature by means of a not shown heater for the pipe arrangement and the heater 20 for the electron source substrate 10.

After the temperature of the substrate 10 had returned to the room temperature, the probe 601 shown in FIGS. 6 and 7 was contacted with the fetch wiring 30 of the electron source substrate 10 shown in FIG. 2. And a voltage was applied between the device electrodes 2 and 3 of each of the electron-emitting devices 6 through the wiring in the X direction 7 and the wiring in the Y direction 8 by the use of the driver 32 through the cable 31. Then the "forming process" of the electroconductive films 4 was performed. Thus, the gaps G shown in FIG. 10 were formed in the electroconductive films 4. The thermal expansion of the electron source substrate 10 owing to the heat generated by the electric current flowing at the time of the "forming process" was controlled to be raised or lowered by the use of the block 105 including the heater 103 and the block 106 including the cooling pipe 109 to change the temperature of the block 104 holding the probe 601 contacting with the fetch wiring 30 of the electron source substrate 10 to apply a voltage. Thereby, the changes of the position of the probe 601 was made to be the same amounts as the changes of the position of the substrate 10 owing to the thermal expansion of the substrate 10. Consequently, the changes of the position of the probe 601 were made to follow the changes of the position of the substrate 10 to coincide with them.

The changes of the temperatures on the side of the electron source substrate 10 and on the side of the block 104 holding the probe 601 contacting with the fetch wiring 30 of the electron source substrate 10 to apply a voltage were controlled to be the same at this time.

Thereby, no discrepancy was generated between the fetch wiring 30 and the probe connecting portion. And any crack and any damage of the substrate 10 and any damage of the probe 601 were not produced. Otherwise, there were no case where the tip of the probe 601 did not contact with the electrode wiring, and then the durability of the probe 601 could be improved. Furthermore, conduction failures were decreased, and the yields of the electron sources ware improved. Moreover, good "forming process" could be executed.

Successively, the "activation process" was performed by the use of the manufacturing apparatus. The valves 25*a*–25*d* for feeding a gas and the valve 25*e* on the side of the feed port of the gas were opened. The mixed gas of the organic material gas 21 and the carrier gas 22 was introduced into the vacuum chamber 12. A nitrogen gas mixed with ethylene was used as the organic material gas 21. A nitrogen gas was used as the carrier gas 22. The pressure indicated by the vacuum gage 27 on the side of the exhaust port 16 was observed while the degree of the opening and closing of the valve 25*f* was adjusted. Thereby the pressure of the inside of the vacuum chamber 12 was made to be $133\times10^2$ Pa (100 Torr)

After the organic gas 21 had been introduced in the vacuum chamber 12, the "activation process" was executed by applying a voltage between the electrodes 2 and 3 of each of the electron-emitting devices 6 through the wiring in the X direction 7 and the wiring in the Y direction 8. Incidentally, the "activation process" was executed by the method in which all of the wiring in the Y direction 8 and not selected lines of the wiring in the X direction 7 are commonly connected with the ground (ground potential) and a pulse voltage was applied to the lines in the X direction one by one in order. By repeating the above-mentioned method, the "activation process" was executed to all of the lines in the X direction. Against the thermal expansion of the electron source substrate 10 owing to the heat generated by the electric current flowing at the time of the "activation process", the probe 601 was moved by the same distance as the elongated amount of the electron source substrate 10 in the similar manner to that at the time of the "forming process". Thereby, no discrepancy was produced between the fetch wiring 30 and the probe connection portion. And any crack and any damage of the substrate 10 and any damage of the probe 601 were not produced. Otherwise, there was no case where the tip of the probe 601 did not contact with the electrode wiring, and then the durability of the probe 601 could be improved. Furthermore, conduction failures were decreased, and the yields of the electron sources ware improved.

A device current $I_f$ (an electric current flowing between device electrodes of the electron-emitting devices) at the time of the completion of the "activation process" was measured to every wiring in the X direction 7. The obtained values of the device currents $I_f$ were compared with each other. As a result, the dispersion of the values was small and it was ascertained that the "activation process" had been executed in a good state.

After the completion of the "activation process", the carbon films 29 were formed on the electron-emitting device 6 with the gap 5 between them as shown in FIGS. 9 and 10.

Moreover, the analysis of the gas on the side of the exhaust port 16 was performed with a not shown mass spectrum measuring apparatus equipped with a differential pumping apparatus at the time of the activation processing. As a result, the mass number 28 of nitrogen and ethylene and the mass number 26 of a fragment of ethylene instantly increased to be saturated at the same time of the introduction of the mixed gas, and the values of both of the mass numbers 28 and 26 were constant during the "activation process".

The electron source 10 which was shown in FIG. 12 and was similar to that of the example 1 was fixed on the rear plate 61 of the image-forming apparatus 68 shown in FIG. 8 being a schematic diagram. After that, the face plate 66 was arranged above the electron source substrate 10 by 5 mm with the supporting frame 62, a not shown exhausting pipe and a getter material put between the face plate 66 and the electron source substrate 10. The sealing of the face plate 66 was performed in an argon gas by the use of frit glass. Thereby, the form of the image-forming apparatus 68 shown in FIG. 8 was made. In comparison with the prior art method where the "forming process" and the "activation process" were performed after sealing the face plate and rear plate, the time necessary for the manufacturing processes of the present example could be shortened. Furthermore, the uniformity of the characteristics of each of the electron-emitting devices 6 of the electron source could be improved.

Moreover, although the warp of the substrate 10 in the case where the size of the substrate 10 was large easily caused the decrease of the yield of the electron source and the dispersion of the characteristics thereof, the improvement of the yield and the decrease of the dispersion of the characteristics could be realized by the provision of the heat conduction member 41 in the example 1.

According to the present invention, it is possible to provide a voltage applying apparatus and an apparatus for manufacturing an electron source, both being capable of being shaped to be small in size and of simplifying their operationality.

Moreover, according to the present invention, it is possible to provide an apparatus and a method for manufacturing an electron source which can improve their manufacturing speeds and are suitable for the mass production of the electron source.

Moreover, according to the present invention, it is possible to provide an apparatus and a method for manufacturing an electron source which can manufacture an electron source having a superior electron-emitting characteristic.

Moreover, according to the present invention, it is possible to provide an image-forming apparatus having a superior appearance quality of an image.

Moreover, according to the present invention, it is possible to provide a voltage applying apparatus and an apparatus for manufacturing an electron source, both being capable of decreasing failures owing to cracks or fractures of a substrate to bring about a high effects on the improvement of the durability of a probe and the improvement of an electroconductive property thereof, and thereby both increasing failures in the manufacturing process of the electron source.

What is claimed is:

1. A voltage applying apparatus comprising:

a first block;

a second block being attached to the first block;

a plurality of probes being fixed to the first block;

a voltage source connected to the probes;

a heater being included in the second block, for heating the first block through the second block; and a temperature controlling for controlling a temperature of the heater.

2. A method of manufacturing an image display device comprising a plurality of electron-emitting devices connected to a plurality of wirings, and a phosphor, said method comprising the steps of;

preparing a substrate having a plurality of wirings, each of which is connected to a plurality of electroconductive films;

connecting the plurality of probes of the voltage applying appartus of claim 8 to the plurality of wirings; and applying a voltage to the plurality of wirings through the probes.

* * * * *

UNITED STATES PATENT AND TRADEMARK OFFICE

CERTIFICATE OF CORRECTION

PATENT NO. : 6,962,516 B2
APPLICATION NO. : 10/236983
DATED : November 8, 2005
INVENTOR(S) : Kazuhiro Ohki et al.

It is certified that error appears in the above-identified patent and that said Letters Patent is hereby corrected as shown below:

ON THE TITLE PAGE [56] REFERENCES CITED:

Foreign Patent Documents, "JP 7-235255 9/1995" should be deleted.

COLUMN 9:

Line 3, "can, be" should read --can be--.

COLUMN 10:

Line 43, "a" should be deleted.

COLUMN 14:

Line 61, "were" (both) should read --was--;
Line 63, "then" should read --therefore--; and
Line 65, "ware" should read --were--.

COLUMN 15:

Line 12, "Torr)" should read --Torr).--;
Line 35, "then" should read --therefore--; and
Line 38, "ware" should read --were--.

UNITED STATES PATENT AND TRADEMARK OFFICE

CERTIFICATE OF CORRECTION

PATENT NO. : 6,962,516 B2
APPLICATION NO. : 10/236983
DATED : November 8, 2005
INVENTOR(S) : Kazuhiro Ohki et al.

It is certified that error appears in the above-identified patent and that said Letters Patent is hereby corrected as shown below:

COLUMN 16:

Line 38, “effects” should read --effect--;
Line 41, “increasing” should read --decreasing--;
Line 51, “temperature controlling” should read --temperature controller--;
Line 56, “of;” should read --of:--; and
Line 61, “appartus” should read --apparatus-- and
“claim 8” should read --claim 1--.

Signed and Sealed this

Twenty-ninth Day of August, 2006

JON W. DUDAS
*Director of the United States Patent and Trademark Office*